US005868285A

United States Patent [19]

Boyte, Sr.

[11] Patent Number: 5,868,285

[45] Date of Patent: Feb. 9, 1999

[54] FLOAT VALVE STRUCTURE FOR CONTROLLING POURING OF LIQUID FROM RESILIENTLY FLEXIBLE CONTAINER

[76] Inventor: James M. Boyte, Sr., 355 Campbell Rd., Carthage, N.C. 28327-8703

[21] Appl. No.: 852,511

[22] Filed: May 7, 1997

[51] Int. Cl.[6] ..... B65D 37/00

[52] U.S. Cl. ..... 222/212; 222/215

[58] Field of Search ..... 222/51, 212, 213, 222/215; 137/192, 397

[56] References Cited

U.S. PATENT DOCUMENTS

| | | | |
|---|---|---|---|
| 3,087,656 | 4/1963 | Dougherty | 222/213 X |
| 3,207,374 | 9/1965 | Holmes et al. | 222/213 X |
| 4,741,448 | 5/1988 | Alley et al. | 222/564 X |
| 4,842,152 | 6/1989 | Donegan | 222/543 X |
| 5,000,353 | 3/1991 | Kostanecki et al. | 222/207 |
| 5,133,479 | 7/1992 | Boyte, Sr. | 222/212 X |
| 5,259,535 | 11/1993 | Boyte, Sr. | 222/213 X |
| 5,370,266 | 12/1994 | Woodruff | 222/212 X |

*Primary Examiner*—Kenneth Bomberg
*Attorney, Agent, or Firm*—IP Group of Pillsbury Madison & Sutro LLP

[57] ABSTRACT

As a removably installable attachment, a float valve arrangement for controlling pouring of liquid from a flexible container is provided with a snap-in connection to the container which provides for relative rotation. A vent hole in the outlet neck regulates pouring, and the float valve ball is flexible for sealing conformation to a non-circular seat. The latter concept also is applicable to a version wherein the floatable ball is provided within the liquid storage space of the container itself.

12 Claims, 6 Drawing Sheets

FLOAT VALVE STRUCTURE FOR CONTROLLING POURING OF LIQUID FROM RESILIENTLY FLEXIBLE CONTAINER

BACKGROUND OF THE INVENTION

In my U.S. Pat. No. 5,133,479, issued Jul. 28, 1992, I have disclosed a flexible container (such as is commonly used for selling motor oil by the quart or liter to be poured through an automotive engine crank case filler spout or valve cover opening), the container being provided with a float valve, closable by squeezing the container body, for facilitating pouring from the container without spilling, despite the need for substantially tilting or inverting the container for pouring, before beginning the pouring.

In my U.S. Pat. No. 5,259,535, issued Nov. 9, 1993, I have disclosed an improvement or elaboration of the initial concept, and particularly details for providing the float valve arrangement as a removably installable attachment for the filler neck of a conventional screw cap closed, flexible walled oil container.

Although those inventions, and the present one, have been and are disclosed primarily in the context of an automotive engine oil container, it is believed to be clear that they have broader applicability, not only for use on or with flexible walled containers for other liquids used in a vehicular service context (such as brake fluid, automatic transmission fluid and windshield washer fluid), but in non-vehicular service contexts for controlling the pouring of other pourable liquids, such as liquid detergent, salad oil and floor wax.

SUMMARY OF THE INVENTION

As a removably installable attachment, a float valve arrangement for controlling pouring of liquid from a flexible container is provided with a snap-in connection to the container which provides for relative rotation. A vent hole in the outlet neck regulates pouring, and the float valve ball is flexible for sealing conformation to a non-circular seat. The latter concept also is applicable to a version wherein the floatable ball is provided within the liquid storage space of the container itself.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
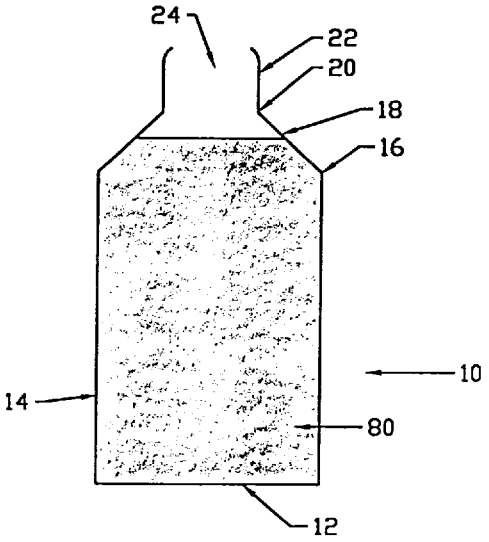
FIG. 1 is a longitudinal sectional view of a conventional flexible-walled container for motor oil.

A conventional flexible-walled container for an easily pourable liquid such as motor oil is shown by itself at 10 in FIG. 1. This one-piece, integrally formed container typically is blow-molded of polyethylene, polypropylene or the like. Although it could be rotationally symmetrical, a form currently in popular use has a rounded-corner, bowed-side rectangular base wall 12 (a narrower side being shown), with a corresponding peripheral sidewall 14 which transitions at a lower, outer, first annular juncture 16 into an upwardly tapering shoulder 18, and at an upper, inner, second annular juncture 20 into a tubular neck 22.

The neck 22 typically is provided with an external molded-in feature (such as screwthreading, not shown), for accommodating removable securement of a closure cap (not shown). The neck 22 further is typically provided at its outlet 24 with a curved-to-radially inwardly directed annular flange 26 of slight but significant radial extent.

The typical container 10 is moderately flexible, at least in its peripheral sidewall 14, so that it can be releasably squeezed for reversibly substantially decreasing its contained volume. (Compare FIGS. 4 and 5.)

Figure 2:
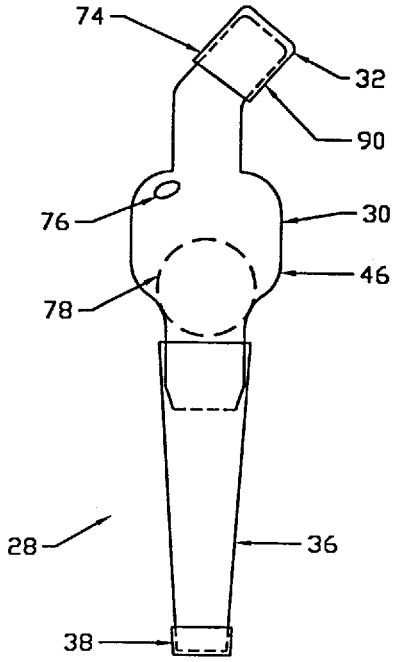
FIG. 2 is a side elevational view of a float valve arrangement for controlling pouring of a liquid such as motor oil, from a flexible-walled container, such as the one shown in FIG. 1, the arrangement being shown provided in the form of a reusable kit.
Figure 3:
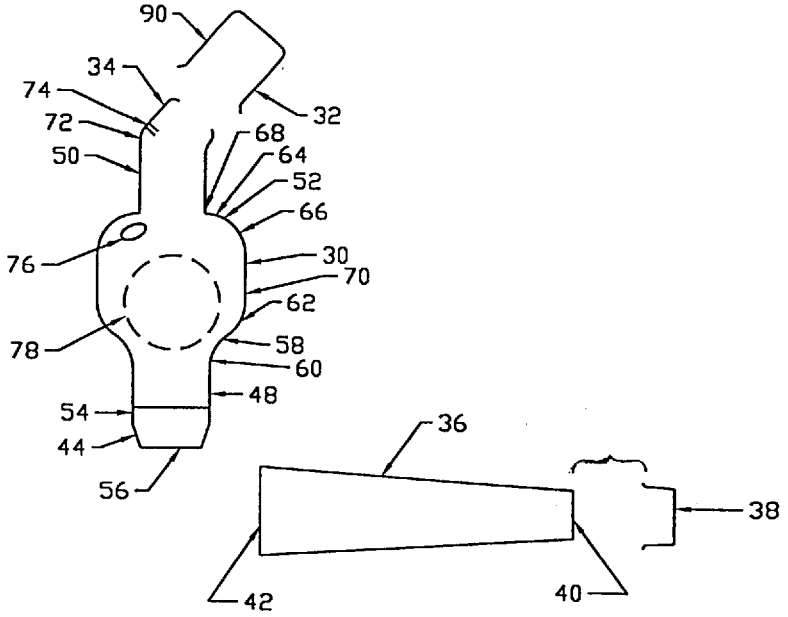
FIG. 3 is an exploded longitudinal sectional view of the arrangement shown in FIG. 2.

In the preferred embodiment of FIGS. 2–10, the float valve arrangement for controlling the pouring of a liquid (such as motor oil) from a flexible container, such as the flexible container 10, is removably attachable to the container 10, and preferably is provided in the form of a kit 28, which is shown assembled in FIG. 2 and disassembled in FIG. 3.

Thus, the kit 28 is shown including the arrangement itself at 30, a cap 32 for its outlet end 34, a frusto-conically tapering tube 36 for extending the outlet end 34, and a cap 38 for the small (outlet) end 40 of the tubular extension 36.

Between uses, the arrangement 30 can be conveniently stored, by jamming the cap 32 onto the outlet end 34, jamming the cap 38 onto the small, outlet end of the tubular extension 36, and jamming the large, inlet end 42 of the tubular extension 36 onto the inlet end 44 of the arrangement 30, to provide the assembled kit 28 shown in FIG. 2. Disassembly is a reverse of the procedure just described, providing the disassembled parts shown in FIG. 3.

The arrangement 30, as shown, includes a tubular body 46 having an inlet neck 48 and an outlet neck 50 extending coaxially in opposite directions from a radially enlarged ball chamber 52.

The inlet neck 48 includes as an axially short external circumferential enlargement 54 with a flaring lead-in located a short distance axially from the opening 56 of the inlet end 44. Thus, the inlet neck is sized and shaped to be jammed into the tubular neck 22 of the container 10, causing the annular flange 26 to ride up the taper of the external surface of the inlet neck 48, until the annular flange 26 snaps past the more abrupt axially inner end of the enlargement 54, thus removably securing the arrangement 30 in an operative position on the neck of the container 10. In this position, the arrangement 30 can be rotated freely about the longitudinal axis of the neck without becoming looser, tighter, or disengaging.

Yet, intentional disengagement is possible by strongly, quickly tugging the arrangement 30 and container 10 in axially opposite directions, enhanced by tilting the arrangement 30 relative to the longitudinal axis of the neck 22.

The outlet neck 50 of the arrangement 30 could be straight, as the inlet neck 48 is shown being. However, it is preferred that the outlet neck 50 have an obtuse-angle bend in it (e.g., a 120° bend), approximately midway along its axial extent, so that, when installed, the arrangement can be oriented and/or rotated on the container 10 to maximize the declination of the outlet end 34.

The ball chamber 52 is shown being a rotationally symmetrical tubular body, with one important exception, discussed below. Thus, beginning from the axially outer end of the inlet neck 48, the peripheral sidewall of the chamber 52 has a conically flaring shoulder 58 axially delimited by smaller and larger circumferential junctures 60, 62, a conically tapering shoulder 64 delimited by larger and smaller circumferential junctures 66, 68 and a cylindrical midbody portion 70 integrally joined with the shoulders 58, 64, at the junctures 62, 66.

The arrangement 30 can be injection molded, e.g., of clear polystyrene, or differential pressure thermoformed of polystyrene, polyethylene or polypropylene. Known techniques and materials can be used; neither form a novel part of the invention. (Generally, the wall thicknesses of the container and arrangement are approximately the same throughout, so, in this description, features on the inside and outside of a structure at any point have not been given separate element numbers.)

By preference, as a consequence of molding, or due to deformation caused when the arrangement 30 is still vulnerable from being molded, the circumferential seat for sealing provided at the small end 68 of the tapering shoulder 68 is caused to be oval, or elliptical or otherwise non-circular, e.g., by either providing that shape in the mold, or by tong-squeezing the newly de-molded product.

The outlet neck 50, just axially outwardly beyond the elbow 72 is preferably provided on the outside of the bend with an air inlet hole 74, which is small in size relative to the bore of the outlet neck.

The conically tapering shoulder 64 of the ball chamber 52, in the quadrant comparable to the outside of the bend of the elbow 72, at two corresponding sites located about 75° apart, with inwardly protruding bosses, dents or dimples 76 (only one of which shows, in the drawings, the other being superimposed, forwards of the drawing plane).

The arrangement 30 is completed by a floater ball 78 which is buoyant on the liquid intended to be poured, substantially impervious to that liquid, and sufficiently resilient that, under conditions of use, it can resiliently deform to provide a circumferential seal on the seat at 68, despite the out-of-roundness of the seat at 68.

The ball 78 can be installed in the chamber 52 by deforming it and forcing it in through one of the end openings, or by molding or reducing the body 46 in diameter around it after placing the ball within the bore of a parison for the body 46. Or, the ball could be expanded or inflated after being installed while having a small size.

Figure 4:
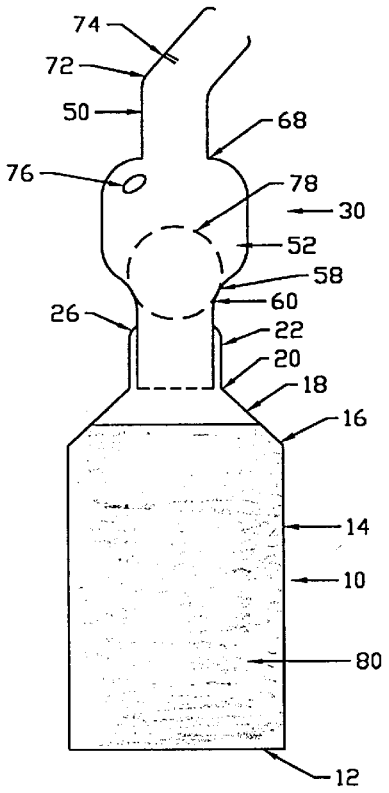
FIG. 4 is a longitudinal sectional view of the arrangement of FIG. 2, installed on the container of FIG. 1.

Assuming, now that the container 10 of pourable liquid 80 has been provided as described above in relation to FIG. 1, and that the arrangement 30 has been provided, and has been installed on the neck of the container 10 as has been described above, mostly with reference to FIGS. 1 and 2, but also with brief reference to FIG. 3 and 4.

At this stage, the combined container 10 of pourable liquid and its attached flow control arrangement 30 are upright, as shown in FIG. 4. The ball, which is shorter in diameter than the free axial space within the chamber 52, rests on the conically flaring shoulder 58, e.g., at the small diameter end 60.

Before substantially tilting or inverting the assembly 10, 30, the user squeezes two sites on the container sidewall towards one another from opposite sides, thereby decreasing the volume of the container 10 so much as to cause some of the liquid to rise through the container neck, through the inlet neck of the arrangement 30, and into chamber 52, thereby causing the floater ball to float upwards and a ring-shaped site thereon to deform into sealing engagement with the seat 68 of the outlet neck 50. (See FIG. 5.)

While maintaining this squeezing action the user can, with assurance of no leakage, substantially tilt (FIG. 6), or fully invert the assembly 10, 30, and position the outer end portion of the outlet neck 50, so that, beyond the elbow 72, it is directed downwards, and into the inlet of the receiver (not shown) into which the liquid 80 in the container 10 is to be poured.

Then, the user relaxes his or her squeezing action, whereupon the floater ball 78 floats away from the seat (FIG. 7), into engagement with the protrusions 76. The flowing liquid does not completely flood the space within the ball chamber 52 or the outlet neck 50. Rather, air pockets (unflooded spaces), remain behind the ball, at 82, and next to the inner end of the air inlet hole 74, at 84.

Figure 7:
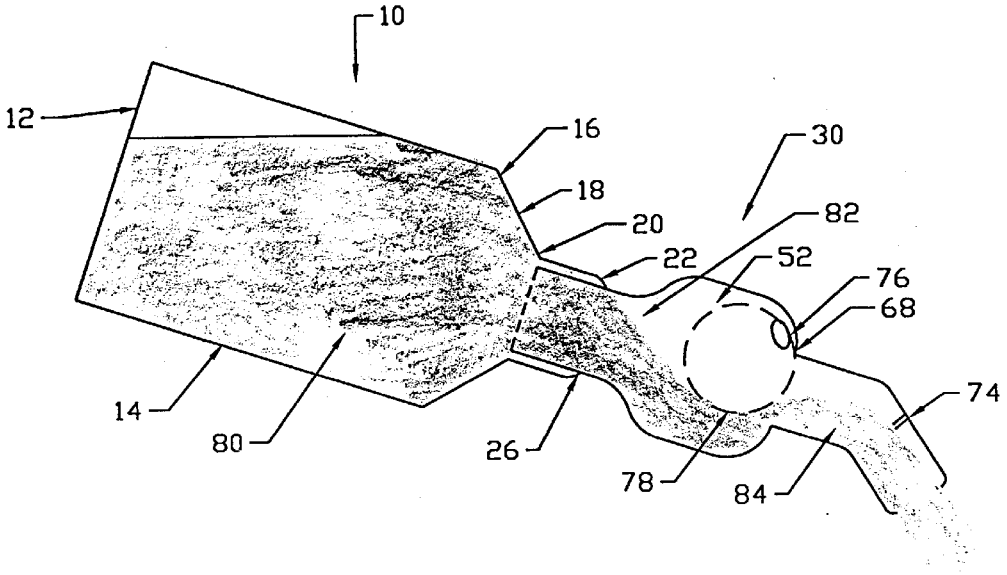
FIG. 7 is a longitudinal sectional view similar to FIG. 6, but showing the effect of releasing of squeezing on the container of the sidewall, so that the ball floats off its seat and liquid begins to pour from the outlet of the arrangement.

If the person, while dispensing liquid as in FIG. 7 decides to stop dispensing, they can cut-off the outflow of liquid simply by squeezing the sidewall again, forcing liquid to flood the space 82 behind the resilient ball and force the resilient ball again into sealing engagement with the out-of-round seat 68. (See FIG. 8.)

Figure 5:
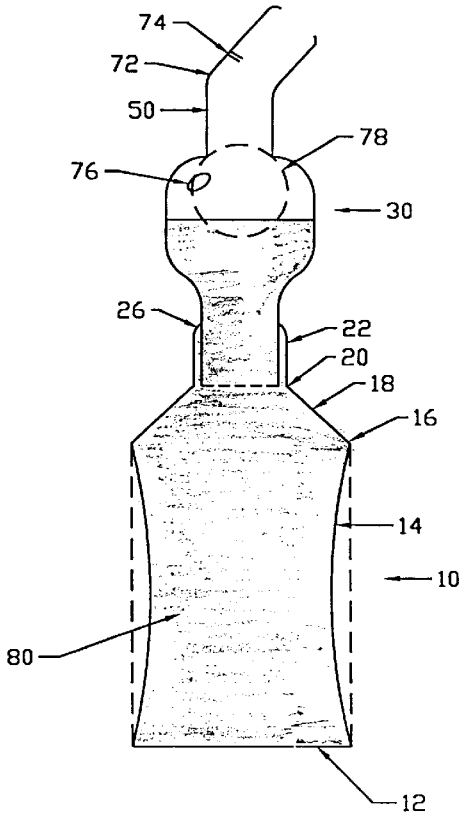
FIG. 5, is a longitudinal sectional view similar to FIG. 4, but showing the effect of squeezing the sidewall of the container, for causing the floatable ball to close the outlet from the arrangement.
Figure 6:
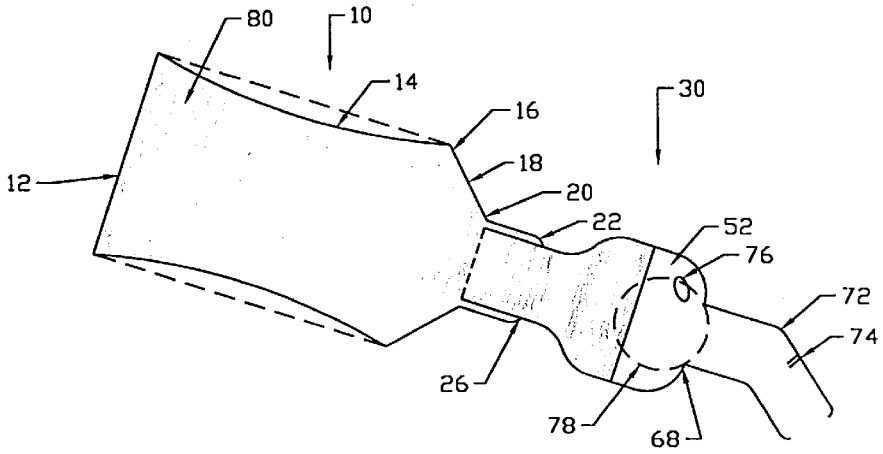
FIG. 6 is a longitudinal sectional view similar to FIG. 5, but showing the effect of tilting the container in order to begin pouring, while maintaining the sidewall squeezed, for causing the floatable ball to continue to close the outlet from the arrangement.
Figure 8:
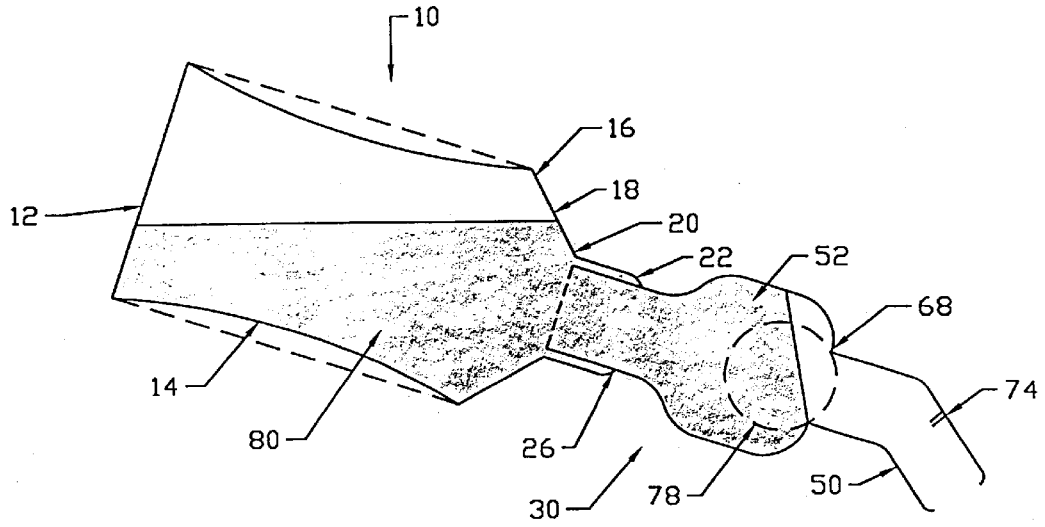
FIG. 8 is a longitudinal sectional view similar to FIG. 7, but showing the effect of re-squeezing the container sidewall to again cause the floatable ball to seat, and so cut-off flow from the outlet of the arrangement.

Rather than hold the container/arrangement assembly tilted at an oblique angle for dispensing, as shown in FIG. 8, the user, while holding the container sidewall squeezed as in FIG. 5, can totally invert the assembly, and release squeezing of the sidewalls, whereupon the resilient ball floats up away from the out-of-round seat 68, and liquid begins to pour from the outlet neck 50. (See FIG. 9.) Once again, air pockets remain in existence at 82 and 84, through the tip portion of the outlet neck 50 may flood as indicated at 86. The flow of liquid can be cut-of by again squeezing the container sidewall, as discussed above in relation to FIG. 8.

Figure 10:
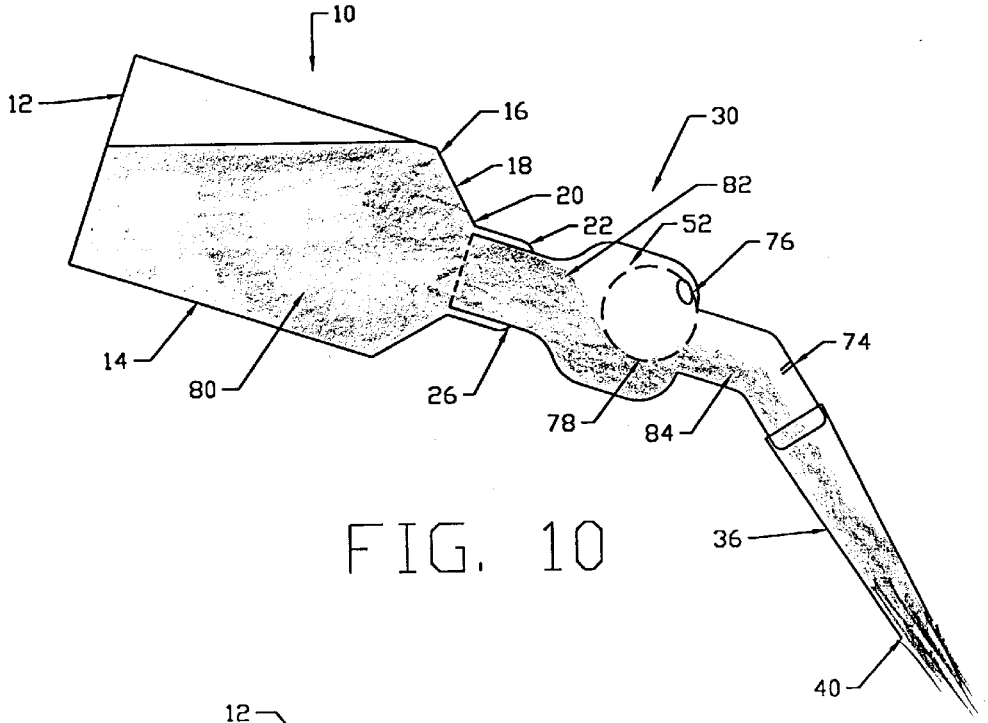
FIG. 10 is a longitudinal sectional view again similar to FIG. 7, but showing a frusto-conical extension tube installed on the outlet of the arrangement.
Figure 9:
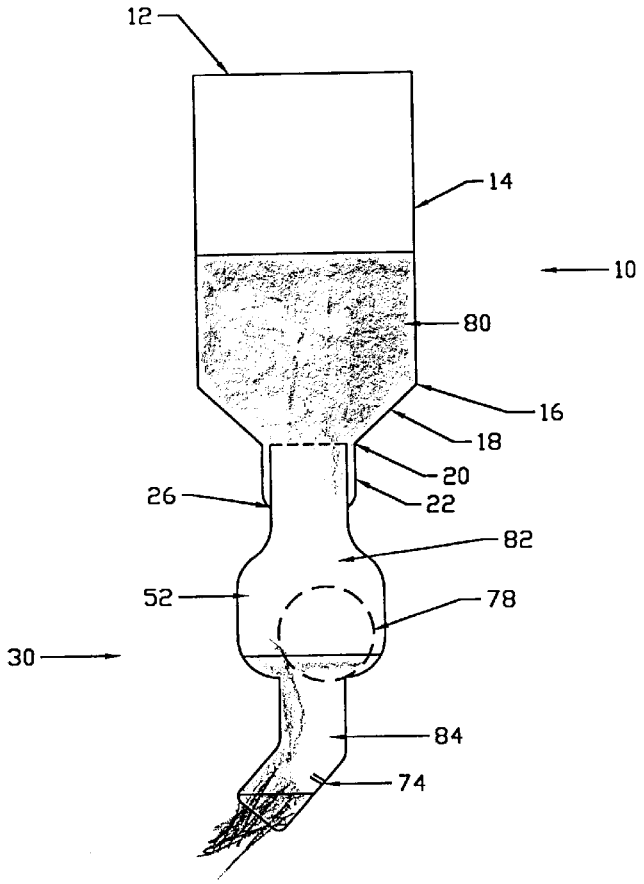
FIG. 9 is a longitudinal sectional view again similar to FIG. 7, but showing the effect of further tilting the combined container and arrangement to a substantially completely vertically inverted position relative to that shown in FIGS. 4 and 5.

FIG. 10 illustrates use of the tapering tube 36 as an extension of the outlet neck 50 by jamming its larger diameter end telescopically onto the tip of the outlet neck 50, as shown. In other respects, use of the assembly 10, 30 is substantially as described above. Note that the inlet air hole 74 remains unblinded by installation of the tapering tube 36.

The protrusions 76 function to keep the ball close enough to the seat, that squeezing of the sidewall (in FIG. 8 causes reseating of the ball).

If the vent hole 74 were omitted, and the tapering tube 36 was installed, the liquid outflow would become slower, causing the air pocket 82 to become filled with liquid, without the sidewall 14 being squeezed, so that squeezing the sidewall could not be relied on to reseat the ball.

The shape of the shoulder 58 and its intersection with the cylindrical portion 70 at 62 preferably are such as to prevent the ball from seating at 62 when squeezing of the container sidewall is released. In particular, the slope at 68, in an annular region next to the seat 68 is oriented so as to be substantially horizontal when the container/arrangement assembly 10, 30 is upright. The diameter of the floater ball relative to the diameter of the outlet neck bore, and the slope of the shoulder 64 preferably are as illustrated in the drawings.

If after the container sidewall has been resqueezed to cut-off liquid flow, as explained above with reference to FIG. 8, the container/arrangement assembly 10, 30 can be again placed upright as in FIG. 5, and squeezing released, as in FIG. 4. Now, if the user decides to dispense again, from the now only partially liquid-filled container, it is not necessary to squeeze the sidewall, but simply to tilt the assembly 10, 30, until flow begins. The chamber 52 accepts the initial amount of liquid emerging from the container, giving the user more time to get the outlet neck positioned where the flow is wanted. From this stage, cutting off the flow again can be accomplished by squeezing the container sidewall, or the liquid can be permitted to completely drain out of the assembly 10, 30.

After usage, the arrangement 30 can be removed from the container 10, and the kit reassembled, as has been described above with reference to FIGS. 2 and 3. Note that the skirt 90 of the cap 32 is long enough to cover and thus close the air inlet hole 74 for non-leaking storage of the kit 28.

The arrangement 30 could be provided with means (not shown) for metering measuring, and/or indicating the amount of liquid flowing therethrough, so a user could squeeze-to-stop-pouring, when an indicated amount of liquid had been poured.

The connection of the container 10 to the arrangement 30 could be made permanent or integral.

FIGS. 11–16 illustrate a simpler embodiment, in which the structures of the container 10 and arrangement 30, are merged into one.

In this embodiment, the container 92 has all of the attributes and capabilities of the container 10, and contains a like pourable liquid 94, except that the non-circular (elliptical, oval or irregularly out-of-round seat) described with reference to element 68 of the first embodiment, and the horizontal annular region described with reference to element 68 of the first embodiment, instead are provided at 96, 98 where the tapering container shoulder 100 transitions to its tubular neck 102, and the floatable resilient ball 104 is provided within the confined space enclosed by the container 92.

Figure 11:
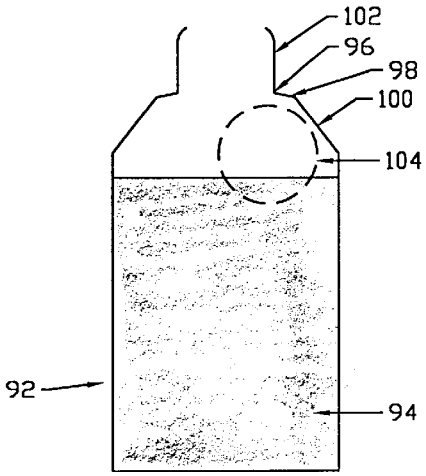
FIG. 11 is a longitudinal sectional view of a modified-shape liquid container provided with a floatable ball for closing-off flow in accordance with the principles of a second embodiment of the present invention.
Figure 12:
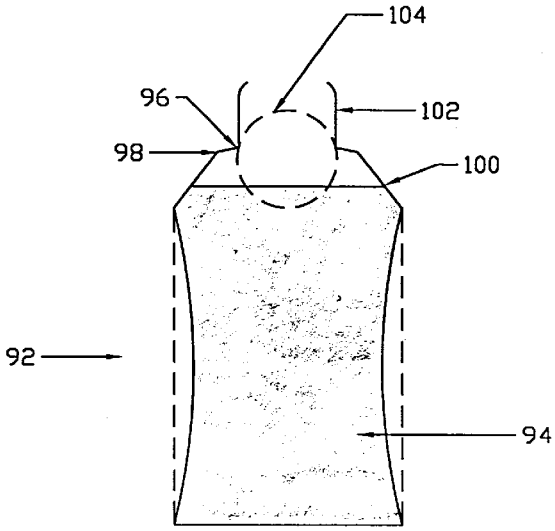
FIG. 12 is a longitudinal sectional view similar to FIG. 11, but showing the effect of squeezing the upright, liquid-filled container for causing the floatable ball to seat and thereby effectively close the outlet from the container.
Figure 13:
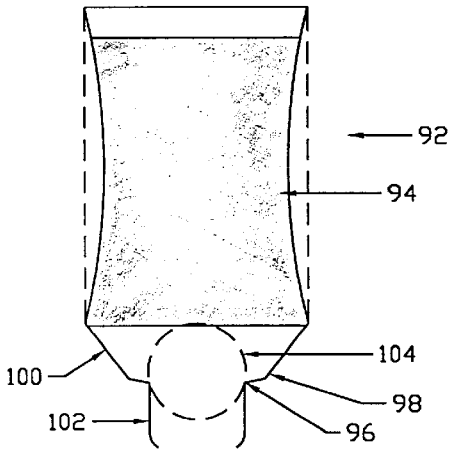
FIG. 13 is a longitudinal sectional view similar to FIG. 12, but showing the container fully inverted, while the ball remains disposed in closing relation to the outlet.
Figure 14:
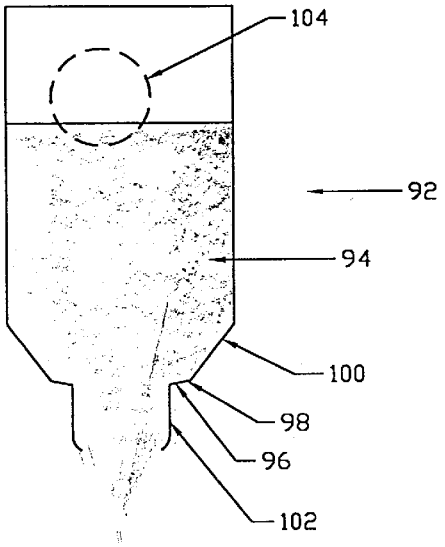
FIG. 14 is a longitudinal sectional view similar to FIG. 13, but showing the effect of releasing squeezing on the container sidewall, so as to permit the ball to float up away from the outlet, allowing liquid to pour out of the container.
Figure 15:
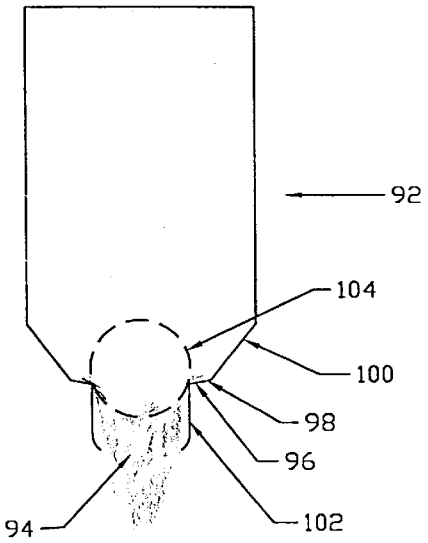
FIG. 15 is a longitudinal sectional view similar to FIG. 14, but shown at a later stage, after most of the liquid has poured out of the container, with the non-circular seat maintaining sufficient clearance from the ball to allow the remainder to pour out.

Thus, in the condition illustrated in FIG. 11 (the container being upright and full of liquid), the ball floats on the liquid, under the seat. Upon squeezing the container sidewall from opposite sides, the ball is caused to rise into and to resiliently deform into seating engagement with the seat 96, whereupon the container can be inverted without liquid pouring out (FIG. 13), until squeezing is released (FIG. 14). As the container, while tilted or inverted, becomes nearly empty of liquid, the out-of-roundness of the seat 96 prevents the ball from reseating as it settles (FIG. 15).

Figure 16:
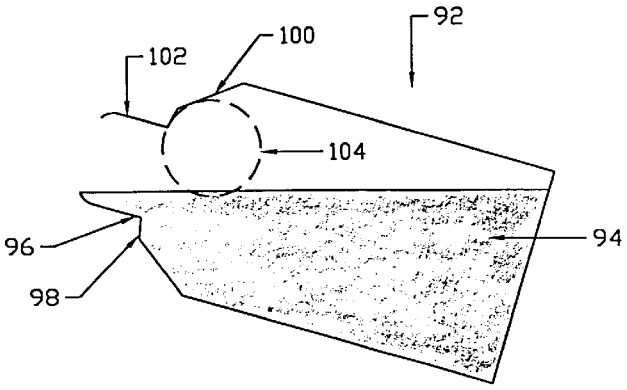
FIG. 16 is a longitudinal sectional view again similar to FIG. 14, but showing the container tilted from an upright position without squeezing to an oblique angle, rather than fully inverted, yet the ball floating sufficiently upward into a modified shoulder space of the container, to permit the liquid to flow out of the container.

When the container 92 is only partly full and is tilted for pouring without squeezing first, the slope of the container wall at 98 permits the ball to float up out of the way of the path of liquid flowing out of the container through the container neck (FIG. 16). Were it not for the horizontal annulus 98, the floater ball would be much more likely to seal the neck at 96 when the partially full container was tilted for pouring.

It should now be apparent that the float valve structure for controlling pouring of liquid from resiliently flexible container as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A float valve structure for controlling pouring of a liquid from a resiliently flexible container, comprising:

a tubular outlet neck having a bore with an inlet end and an outlet end; a conical peripheral shoulder which converges in width towards said outlet end of said neck;

an annular seat connecting said conical shoulder with said outlet end of said neck; said annular seat being oriented so as to be substantially horizontal when said outlet neck and shoulder are disposed upright;

a floater ball made of resilient material and having a larger diameter than the radially inner extent of said annular seat; and said annular seat being out-of-round relative to said ball, such that some resilient deformation of said ball upon being forced on floating liquid into juxtaposition with said annular seat, is needed for effecting a complete annular seal between the floater ball and the annular seat.

2. The float valve structure of claim 1, wherein:

said conical peripheral shoulder is provided as an axially intermediate feature of a tubular arrangement having an inlet neck and said tubular outlet neck; and further including a connection of the inlet neck to an outlet neck of an elastically flexible container for liquid.

3. The float valve structure of claim 2, wherein:

said elastically flexible container contains motor oil as a liquid pourable therefrom through said outlet neck of said elastically flexible container.

4. The float valve structure of claim 2, wherein:

said connection of said inlet neck of said tubular arrangement to said outlet neck of said elastically flexible container is a telescopically snapped-together connection which permits free rotation of said arrangement relative to said container through 360° about said outlet neck of said container.

5. The float valve structure of claim 4, wherein:

said outlet neck of said arrangement includes an obtuse angle bend intermediate axially opposite ends thereof, so that an outer tip portion thereof, beyond said bend, can be aimed in a desired direction.

6. The float valve structure of claim 5, further including:

a removable cap for said tip portion of said outlet neck of said arrangement.

7. The float valve structure of claim 6, further including:

an air vent opening provided radially through said tip portion of said outlet neck on the outside of said bend;

said cap having a skirt covering said air vent opening.

8. The float valve structure of claim 5, further including:

an air vent opening provided radially through said tip portion of said outlet neck on the outside of said bend.

9. The float valve structure of claim 2, wherein:

said tubular arrangement includes an enlarged chamber between said inlet neck and outlet neck thereof, said conical peripheral shoulder and said annular seat forming part of said enlarged chamber; and said ball being floatably disposed in said chamber.

10. The float valve structure of claim 9, further including protrusions formed on said conical shoulder for cooperation with said floater ball to maintain a predetermined spatial relation of the floater ball to the annular seat when the structure is tilted from vertical for pouring liquid from said tubular outlet neck.

11. The float valve structure of claim 7, further including:

a tapering tubular extension having a larger diameter end which is telescopically fittable onto said tubular outlet neck without covering said air inlet hole;

said tapering tubular extension further having a smaller diameter end provided with a removable cap.

12. The float valve structure of claim 11, wherein:

said larger diameter end of said tapering tubular extension is arranged to be alternatively removably fitted onto said inlet neck of said arrangement, whereby said arrangement, extension and caps can be removably assembled to one another to provide a closed kit.

* * * * *